US010758062B1

(12) United States Patent
Eisenhauer

(10) Patent No.: US 10,758,062 B1
(45) Date of Patent: Sep. 1, 2020

(54) BOTTLE DISPENSATION AND MARKETING DISPLAY ASSEMBLY

(71) Applicant: Jessi L. Eisenhauer, Selma, OR (US)

(72) Inventor: Jessi L. Eisenhauer, Selma, OR (US)

( * ) Notice: Subject to any disclaimer, the term of this patent is extended or adjusted under 35 U.S.C. 154(b) by 0 days.

(21) Appl. No.: 16/435,140

(22) Filed: Jun. 7, 2019

Related U.S. Application Data

(60) Provisional application No. 62/719,035, filed on Aug. 16, 2018.

(51) Int. Cl.
*A47F 3/02* (2006.01)
*A47F 7/28* (2006.01)

(52) U.S. Cl.
CPC ..... *A47F 3/02* (2013.01); *A47F 7/281* (2013.01)

(58) Field of Classification Search
None
See application file for complete search history.

(56) References Cited

U.S. PATENT DOCUMENTS

| | | | | |
|---|---|---|---|---|
| 1,752,479 | A | 9/1927 | Dotson | |
| 1,730,437 | A | 2/1928 | Sanderson | |
| 2,459,715 | A | 7/1947 | Newman | |
| 2,837,216 | A | 3/1954 | Paige | |
| 3,072,246 | A | 1/1963 | Goldstein | |
| 3,123,207 | A | 3/1964 | Goldstein | |
| 3,216,560 | A | 11/1965 | Goldstein | |
| 3,397,772 | A | 8/1968 | Farquhar | |
| 5,379,905 | A | 1/1995 | Bustos et al. | |
| 5,971,204 | A | 10/1999 | Apps | |
| 6,112,938 | A | 9/2000 | Apps | |
| 6,237,777 | B1 | 3/2001 | Bierly | |
| 6,739,461 | B1 | 3/2004 | Robinson | |
| 7,918,365 | B2 | 4/2011 | White et al. | |
| 7,997,427 | B2 * | 8/2011 | Lowenbraun | A47F 1/12 211/59.2 |
| 8,387,828 | B2 | 3/2013 | Moothart | |
| 8,910,827 | B2 | 12/2014 | Lockwood | |
| 9,326,602 | B2 | 3/2016 | Gupta | |
| 9,669,966 | B2 | 6/2017 | Ruijssenaars et al. | |
| 9,969,523 | B2 | 3/2018 | Ayerst | |
| 2008/0245813 | A1 * | 10/2008 | Johnson | A47F 5/0018 221/194 |

(Continued)

*Primary Examiner* — Gene O Crawford
*Assistant Examiner* — Ayodeji T Ojofeitimi
(74) *Attorney, Agent, or Firm* — Jerry Haynes Law

(57) ABSTRACT

A bottle dispensation and marketing display assembly is configured to both dispense multiple bottles in an efficient, energy-free means, and also to ornamentally display the bottles, and cards describing the bottles in a unique assembly that can be mounted in a retail space with minimal shelf-space, and connected in a modular arrangement with other assemblies carrying similar or dissimilar bottles. A housing containing the bottles mounts to a surface and attaches to adjacent housings. The assembly utilizes gravity feed dispensing means to dispense the bottles, such that when removing a first bottle from an outlet opening, a subsequent bottle quickly falls to the outlet opening in a controlled, aligned manner. A transparent case retains one bottle for display, and an at least partially transparent raised panel retains a card for providing information, so as to enable optimal viewing and information gathering of the bottles contained within.

20 Claims, 7 Drawing Sheets

(56) References Cited

U.S. PATENT DOCUMENTS

| | | | | |
|---|---|---|---|---|
| 2009/0272756 | A1* | 11/2009 | Hackney | A47F 5/112<br>221/154 |
| 2010/0096401 | A1* | 4/2010 | Sainato | A47F 1/087<br>221/8 |
| 2012/0091163 | A1* | 4/2012 | Lowry | A47F 1/082<br>221/1 |
| 2013/0024022 | A1* | 1/2013 | Bowers | A61J 1/03<br>700/236 |

* cited by examiner

BOTTLE DISPENSATION AND MARKETING DISPLAY ASSEMBLY

CROSS-REFERENCE TO RELATED APPLICATIONS

This application claims the benefit of U.S. provisional application No. 62/719,035, filed Aug. 16, 2018 and entitled MODULAR BOTTLE DISPENSATION SHOWCASE APPARATUS, which provisional application is incorporated by reference herein in its entirety.

FIELD OF THE INVENTION

The present invention relates generally to a bottle dispensation and marketing display assembly. More so, the present invention relates to a dispensation and display assembly that stores and dispenses individual bottles of a fluid in a housing defined by sidewalls forming apertures used for fastening the housing to a mounting surface, or detachable attachment of the housing to an adjacent housing for modular display arrangements, thereby allowing multiple housings to stack on top of each other for marketing and space-saving purposes; whereby the housing forms an inlet opening for loading bottles, an outlet opening for dispensing bottles, and a passageway connecting the inlet opening to the outlet opening, creating a gravity feed dispensing means, such that gravity urges the bottles to towards the passageway (bottles fall into place) while substantially maintaining alignment of the bottles at the outlet opening; and whereby an at least partially transparent case snaps onto one side of the housing to display an individual bottle, and an at least partially transparent raised panel snaps onto a second side of the housing to display a card.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, consumable liquid bottles are used for containing eclectic beverages, foodstuffs, petroleum products, cosmetics, and the like. These bottled fluid-like products are optimally retailed when displayed in an attractive manner, and dispensed easily from their container. Often, beverage containers, such as bottles, are displayed and sold individually at grocery stores, gas stations, drug stores, convenience stores and liquor stores. Typically, the beverage containers are manually loaded onto a display rack, shelving unit, or refrigeration display unit.

In the shelving arrangement of a typical store there often is an unutilized area because the uppermost shelf generally is not stocked with bottles. This is because the higher level is usually inconvenient for stocking by a stockperson, as well as being inconvenient for a customer to remove bottles. This is especially true for any bottles which may be stocked in rows rearward of the aisle edge of such top shelf.

Other proposals have involved display and dispensing units for bottles in a retail environment. The problem with these display and dispensing units is that they do not magnify allow for convenient dispensing of the bottles in a gravity fed manner. Also, these units do not display the bottles in an effective marketing manner. Even though the above display and dispensing units meet some of the needs of the market, a modular bottle dispensation showcase assembly that displays bottles and provides easy access to the bottles while detachably mounting to a mounting surface, and stacking/linking in an ornamental arrangement with adjacent showcase assemblies, is still desired.

SUMMARY

Illustrative embodiments of the disclosure are generally directed to a modular bottle dispensation showcase assembly. The modular bottle dispensation showcase assembly serves to control the display and access to multiple bottles that contain a fluid, and that are housed for individual display and sale in a retail environment. The showcase assembly is unique in that the bottles are dispensed through gravity-fed means, such that when removing a first bottle from an outlet opening, a subsequent bottle quickly falls to the outlet opening in a controlled, aligned manner. The showcase assembly is configured to display the bottles and a bottle information card in an ornamental manner, so as to optimize shelf space and marketing. The assembly also mounts to a variety of mounting surfaces, and has the modular capacity to link with adjacent showcase assemblies for creating efficient shelf space and marketing.

In one aspect, the modular bottle dispensation showcase assembly, comprises at least one housing defined by a bottom base wall and multiple sidewalls forming a cavity, the sidewalls further forming a pair of spaced-apart, parallel mount holes, the sidewalls further forming multiple case holes, the sidewalls forming multiple panel holes, the sidewalls defined by an upper end and a lower end, the upper end of the sidewalls forming multiple modular clip reception slots, the upper end of the sidewalls further forming an inlet opening, the lower end of the sidewalls forming an outlet opening, the housing being operable to enable containment of multiple bottles, whereby gravity urges the bottles from the inlet opening to the outlet opening.

In some embodiments, the assembly provides multiple mounting clips disposed at the upper end of the sidewalls, the mounting clips sized and dimensioned to detachably mate with a corresponding modular clip reception slot, whereby the adjacent housings are attachable in a modular arrangement.

In some embodiments, the assembly provides a lid detachably fitted to the edge of the upper end of the sidewalls.

In some embodiments, the assembly provides at least one case being detachably attachable to the sidewalls, the at least one case containing at least one of the bottles for display.

In some embodiments, the assembly provides multiple case tabs extending from the case, whereby the case tabs mate with corresponding case holes in the sidewall in a snap-fit relationship, such that the case detachably attaches to the housing.

In some embodiments, the assembly provides at least one panel, the panel being at least partially transparent, the panel being detachably attachable to the sidewalls, the raised panel being operable to enable retention of a card. Multiple panel tabs extend from the panel for mating with the mount holes.

In another aspect, the assembly further comprises at least one mount hole extending from a rear sidewall. A bolt (fastener) would already be attached to the peg board, and the housing then attaches to the bolt using the mount hole opening.

In another aspect, the housing has a rectangular shape.

In another aspect, the outlet opening has a U-shape.

In another aspect, the lid forms a snap-fit relationship with the sidewalls.

In another aspect, the case tabs mate with corresponding case hole in the sidewall in a snap-fit relationship.

In another aspect, the panel tabs mate with corresponding panel hole in the sidewall in a snap-fit relationship.

In another aspect, the bottles are defined by a 50 milliliter volume.

In another aspect, the assembly further comprises multiple case tabs extend from the case.

In another aspect, the sidewalls form multiple case holes.

In another aspect, the case tabs mate with corresponding case holes in the sidewall in a snap-fit relationship, such that the case detachably attaches to the housing.

In another aspect, the assembly further comprises multiple panel tabs extend from the case.

In another aspect, the sidewalls form multiple panel holes.

In another aspect, the panel tabs mate with corresponding panel holes in the sidewall in a snap-fit relationship, such that the panel detachably attaches to the housing.

In another aspect, the outlet opening is defined by a U-shaped edge.

In another aspect, the inlet opening and the outlet opening are disposed on opposing sidewalls.

In another aspect, the gravity urges the bottles from the inlet opening to the outlet opening when bottles are removed from the outlet opening.

One objective of the present invention is to dispense multiple bottles in an efficient, energy-free means, and also to ornamentally display the bottles, and cards describing the bottles in a unique assembly that can be mounted in a retail space with minimal shelf-space.

Another objective is to connect multiple housings in a modular arrangement with other assemblies carrying similar or dissimilar bottles.

Another objective is to efficiently stock and display 50 ml bottles in an attractive configuration.

Another objective is to stack and arrange the housings in an ornamental manner.

Yet another objective is to utilize gravity to urge the bottles to the dispensing outlet opening.

Yet another objective is to stack and link the housing with adjacent housings for enhanced stability, space-saving, and decorative effect.

Yet another objective is to mount the housing to a peg wall.

Yet another objective is to arrange the housing, so as to create more space in a retail environment.

Yet another objective is to display an individual bottle in the transparent case outside the housing for a consumer to view the label, contents, and shape of the bottle.

Yet another objective is to display a card with a transparent raised panel outside the housing, so as to display information pertinent to the bottle.

Yet another objective is to provide an inexpensive to manufacture bottle dispensing and display for bottles containing beverages, foodstuffs, cosmetics, or petroleum products.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 6A shows a rear view of the assembly with the panel attached, and FIG. 6B shows a rear view of the assembly with the panel detached, in accordance with an embodiment of the present invention.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A bottle dispensation and marketing display assembly is referenced in FIGS. 1-7. The bottle dispensation and marketing display assembly, hereafter "assembly", is configured to both dispense multiple bottles in an efficient, energy-free means, and also to ornamentally display the bottles, and cards describing the bottles in a unique assembly that can be mounted in a retail space with minimal shelf-space, and connected in a modular arrangement with other assemblies carrying similar or dissimilar bottles.

Figure 1:
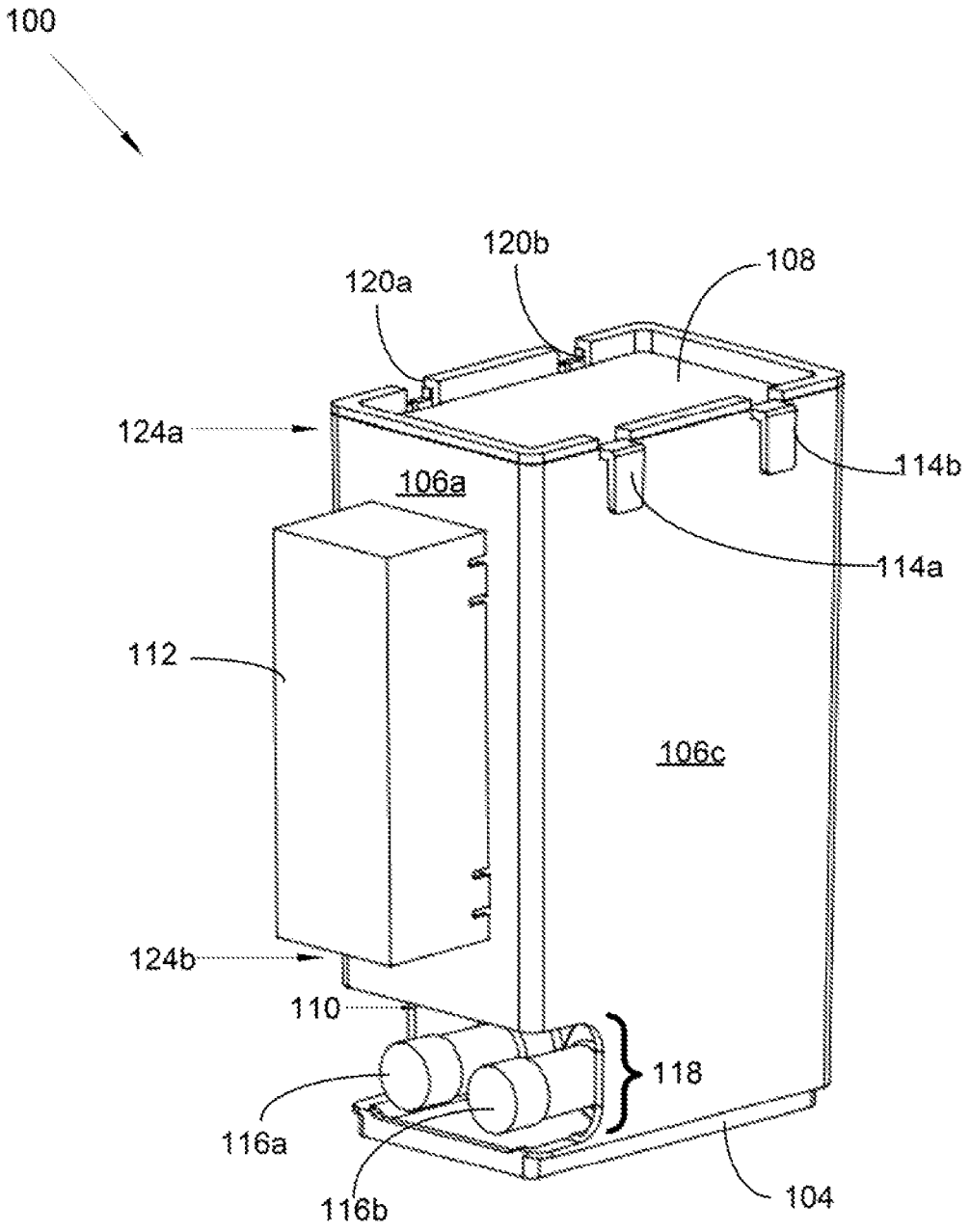
FIG. 1 illustrates a perspective view of an exemplary bottle dispensation and marketing display assembly containing bottles, in accordance with an embodiment of the present invention.

As referenced in FIG. 1, the showcase assembly 100 comprises at least one housing 102 that is sized and dimensioned to store, receive, and dispense multiple individual bottles 116*a-e*. The bottles 116*a*, 116*b*, 116*c*, 116*d*, 116*e* may include 50 ml bottles having a wide body and a narrow neck forming an opening (FIG. 1). Though in other embodiments, any type or size of bottle, and container of a fluid, can be used, as the showcase assembly 100 is scalable. The assembly 100 is designed for retail environments, where efficient display and dispensing is important.

The at least one housing 102 is defined by sidewalls 106*a-d* and a bottom base wall 104 forming a containment for the bottles in a cavity 110 that forms therein. The sidewalls 106*a-d* are defined by an upper end 124*a* and a lower end 124*b* that is disposed at a lower elevation than the upper end 124*a* when the housing 102 is operational, or mounted for display and dispensing the bottles 116*a-e*. The housing 102 also includes a bottom base wall 104 abutting the lower end 124*b* of the sidewalls 106*a-d*. A lid 108 fits over the upper end 124*a* of the sidewalls 106*a-d*. In some embodiments, the housing 102 may include a rectangular shape, and the sidewalls 106*a-d* are rigid, such as from a rigid polymer, metal material, rubber, or wood.

Figure 2:
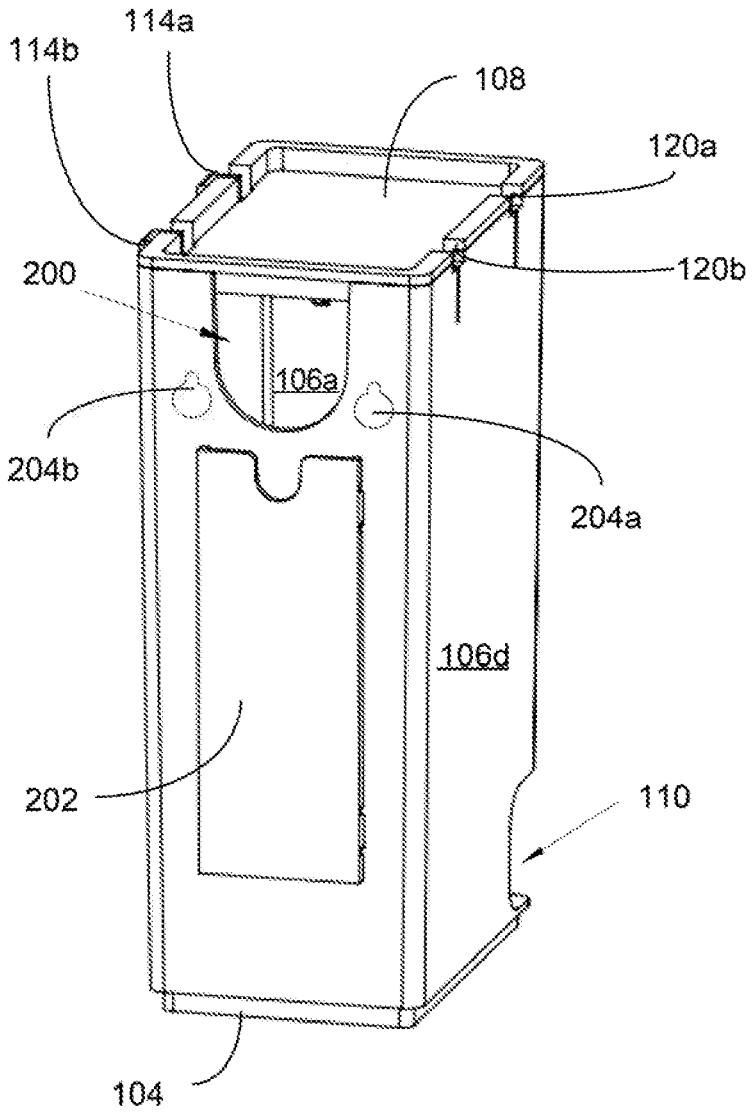
FIG. 2 illustrates a top plan of the bottle dispensation and marketing display assembly, shown in FIG. 1 in accordance with an embodiment of the present invention.

Turning now to FIG. 2, multiple mounting clips 114*a-b* are disposed at the junction of the sidewalls 106*a-d* and the lid 108. Mounting clips 114*a-b* allow housing to be mounted to a surface, such as a wall, nail, shelf, or other surface that mates with mounting clips 114*a-b*. In one non-limiting embodiment, two mounting clips 114*a*, 114*b* are on a first side of the sidewalls 106*a*. Mounting clips 114*a-b* are also operable to detachably attach to an adjacent housing in a colinear relationship.

Furthermore, multiple modular clip reception slots 120*a*, 120*b* form on a second side of the sidewalls 106*b*, opposite the side of the first sidewall having the mounting clips 114*a-b*. The modular clip reception slots 120*a-b* are sized and dimensioned to receive a corresponding mounting clips 114*a-b* of an adjacent housing. In this manner, multiple housings can be detachably joined together in a colinear relationship. This can be effective for magnifying the display effect, as different types of bottles can be arranged in a colinear, adjacent disposition.

In this manner, multiple housings to stack on top of each other for marketing and space-saving purposes. In one non-limiting embodiment, pegs or other protruding members may join the modular apertures. Though in other embodiments, the modular apertures have raised flanges that slid 108*e* into each other to form a locking relationship between housings.

For example, a pyramid arrangement of housings, with each housing containing a different type of bottle could be arranged. The housings could be loosely stacked, or detachably attached through modular apertures, as described below. By stacking the housings in various modular arrangements, space is saved and the bottles 116*a-e* can be presented in a more attractive way. Also by stacking multiple housings in such a manner, different brands and types of bottles 116*a-e* can be presented for optimal sales and display effect.

Figure 4:
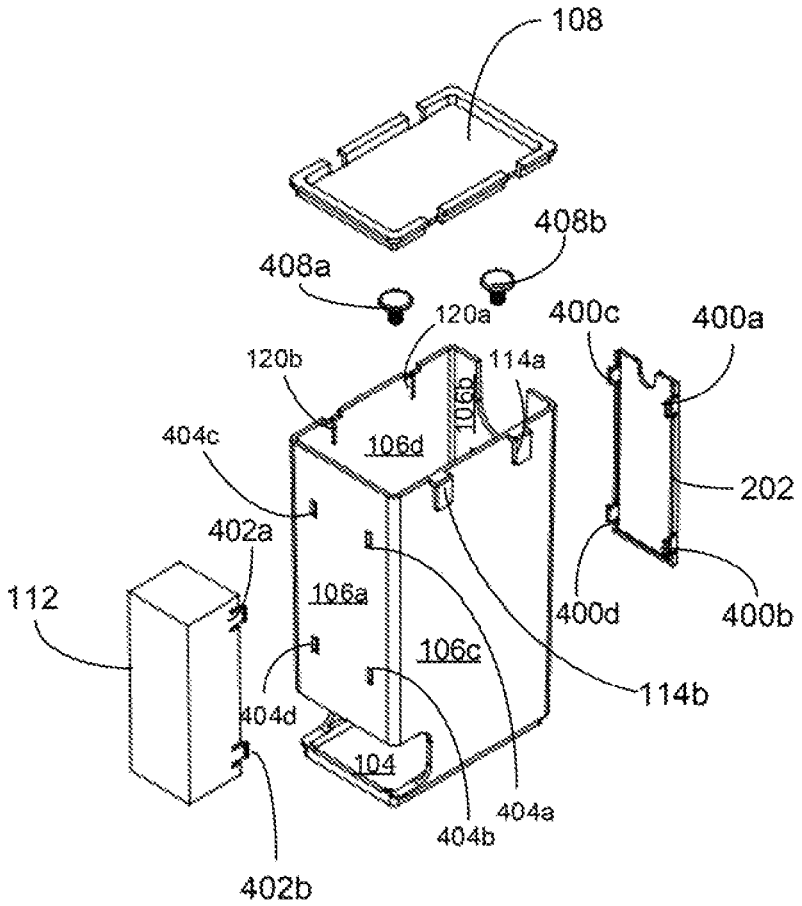
FIG. 4 illustrates an exploded view of the bottle dispensation and marketing display assembly, in accordance with an embodiment of the present invention.

Turning now to FIG. 4, the housing forms an inlet opening 200 through at least one of the sidewalls 106*a-d*. In one embodiment, the upper edges of the sidewalls 106*a-d* define the inlet opening 200. The inlet opening 200 enables passage into a cavity 110 for containing the bottles 116*a-e*. Inlet opening 200 may be shaped and dimensioned to enable a hand to push through multiple bottles simultaneously.

The bottles 116*a-e* are stacked on each other, buttressing each other to create a snug structural reinforcement inside the housing 102. The base wall 104 and sidewalls 106*a-d* are sufficiently rigid to maintain this stacked arrangement. Through the inlet opening 200, the bottles 116*a-e* can be placed in the cavity 110 in an organized arrangement that allows the bottles 116*a-e* to fall from the elevated inlet opening 200 to a lower outlet opening 118 in a steady, gravity-fed manner. The outlet opening 118 may have a wide, U-shaped edge 118 that is sufficiently wide enough to enable more than one bottle to be dispensed therefrom. For example, the necks of the bottles 116*a-e* can be oriented in the same direction, towards the end of the housing 102 forming the outlet opening 118.

Figure 3:
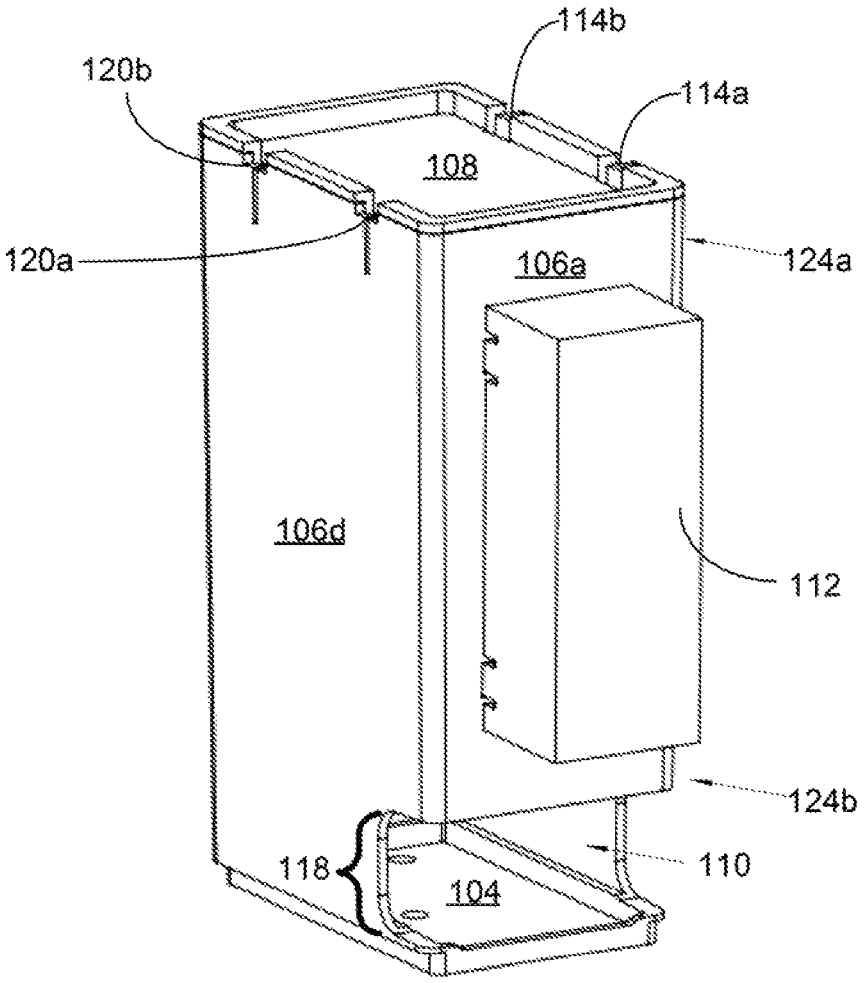
FIG. 3 illustrates a front perspective view of the modular bottle dispensation showcase assembly, in accordance with an embodiment of the present invention.

Looking at FIG. 3, the assembly 100 provides a lid 108 that detachably attaches to the sidewalls 106*a-d* to cover the inlet opening 200 and thereby, regulate access to the cavity 110. The lid can form a snap-fit relationship, or a slidable relationship with the sidewalls for opening and closing. In some embodiments, at least one lid fastener 408*a*, 408*b* fastens the lid 108 to the sidewalls 106*a-d*. Lid fastener 408*a-d* may include a threaded screw, a bolt, a magnet, and other fastening mechanism known in the art.

Figure 5:
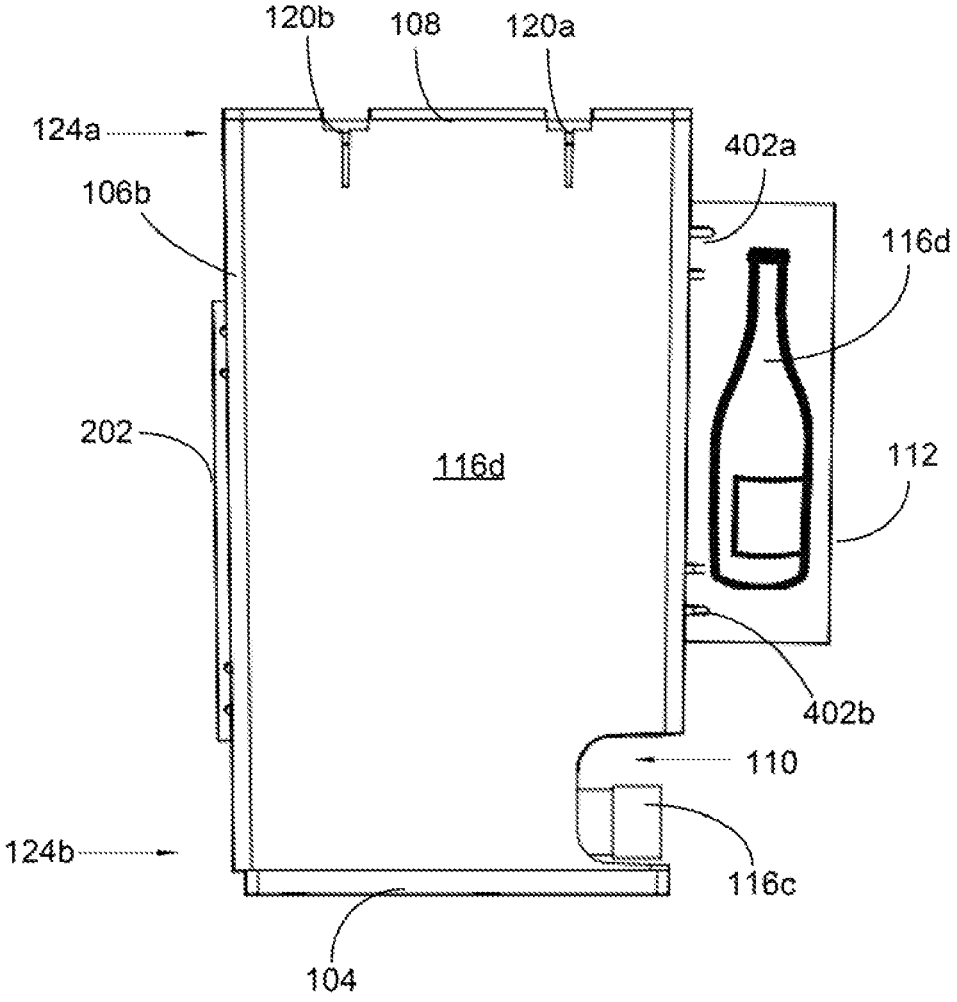
FIG. 5 illustrates an elevated side view of the bottle dispensation and marketing display assembly, in accordance with an embodiment of the present invention.

Looking now at FIG. 5, the sidewall housing 102 forms an inlet opening 200 for loading bottles 116*a-e*, an outlet opening 118 for dispensing bottles 116*a-e*, and a passageway through the cavity 110 connecting the inlet opening 200 to the outlet opening 118. When mounted or stacked, the housing 102 is oriented such that the inlet opening 200 is at a higher elevation than the outlet opening 118. This creates a gravity feed dispensing means, such that gravity urges the bottles 116*a-e* to towards the passageway when a bottle 116*a* is removed from the outlet opening 118, while substantially maintaining alignment of the bottles 116*a-e* at the outlet opening 118.

As shown in FIG. 2, the assembly 100 comprises at least one mount hole 204*a*, 204*b* that forms in the sidewall 106*d*. Mount hole 204*a-b* may have a shape that receives a peg, bolt, or other fastening mechanism from a peg board for attachment to a mounting surface, such as a peg board, wall, a shelf, and a table. Mount hole 204*a-b* may include two-spaced-apart mount holes, or possible more than two mount holes. An alternative embodiment of mount holes 600*a*, 600*b*, shown in FIG. 6B, are larger than mount holes 204*a-b*. The larger mount holes 600*a-b* are displayable when the panel 202 is detached from housing 102. In one non-limiting embodiment, the mount hole 204*a-b* includes threaded or tapered bolts, screws, magnets, adhesives, and other mounting means known in the art.

Looking at FIG. 5, the showcase assembly 100 also provides at least one case 112*a-b* that provides unique showcasing of the bottle 116*d*. In one non-limiting embodiment, the case 112*a-b* is elongated to match the length of the bottle, and has a rounded shape that ends at two edges. The case 112*a-b* is at least partially transparent and detachably attaches, or snaps, onto one side of the housing 102 in a friction fit coupling relationship. In one embodiment, multiple case tabs 402*a*, 402*b*, 402*c*, 402*d* extend from the case 112. The sidewalls 106*a-d* form multiple case holes 404*a*, 404*b*, 404*c*, 404*d* that are aligned with the case tabs 402*a-d*. The case tabs 402*a-d* mate with corresponding case holes 404*a-d* in the sidewall in a snap-fit relationship, such that the case 112 detachably attaches to the housing 102.

While attached to the housing, and containing bottles, the case 112*a-b* is sized and dimensioned to prominently display the bottle 116*d* that is contained in the housing 102. The case 112*a-b* allows the bottle 116*d* to display in a clear, prominent manner from the housing 102. In this manner, a consumer will not have to remove a bottle from the housing 102 to view the labeling, contents, and shape of the bottle.

In another marketing component, the showcase assembly 100 provides at least one panel 202 to display a card or placard, often used in retail environments. The panel 202 that is sized to enable a card or placard to slide between the sidewall and the panel 202. The displayed card may include information about the bottle or contents therein. For example, a description of a beverage, a nutrient count, and a price may display on the card. The panel 202 is configured to detachably attaches to the housing for retaining a card.

Figure 6A:
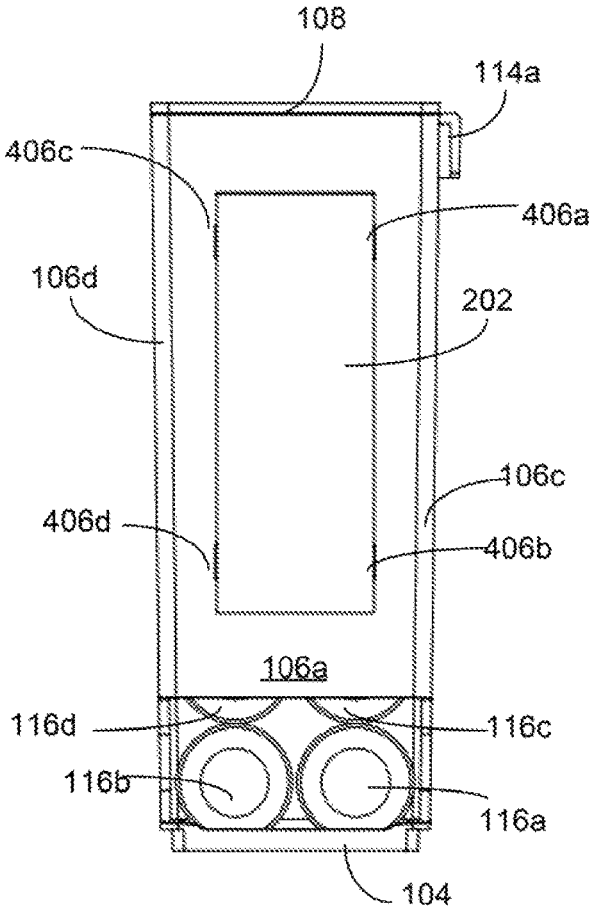
FIGS. 6A and 6B illustrate the bottle dispensation and marketing display assembly with and without the panel attached to the housing, where
Figure 6B:
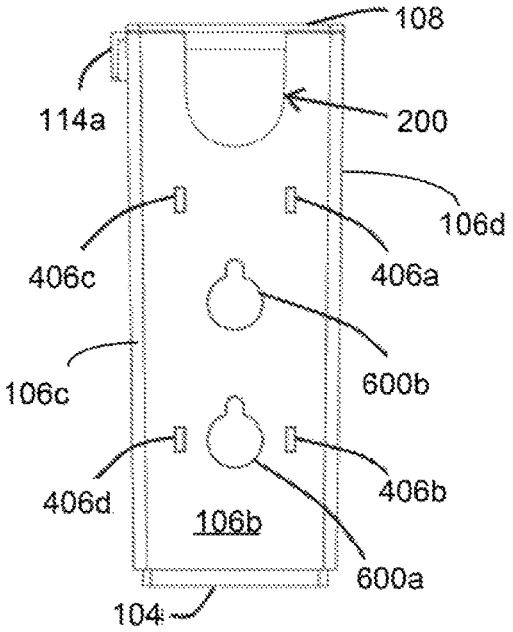

FIGS. 6A and 6B illustrate the bottle dispensation and marketing display assembly with and without the panel attached to the housing, where FIG. 6A shows a rear view of the assembly with the panel attached to a front sidewall 106*a*, and FIG. 6B shows a rear view of the assembly with the panel 202 detached from the rear sidewall 106*b* of the housing 102. It is significant to note that the panels can be detachably attached on any of the sidewalls 106*a-d*. The panel 202 is at least partially transparent, and detachably fastens, or snaps onto a second sidewall 106*d* of the housing 102 in a friction fit coupling relationship.

In one embodiment, multiple panel tabs 400*a*, 400*b*, 400*c*, 400*d* extend from the case 112. The sidewalls 106*a-d* form multiple panel holes 406*a*, 406*b*, 406*c*, 406*d* that are aligned with the panel tabs 400*a-d*. The panel tabs 400*a-d* mate with corresponding panel holes 406*a-d* in the sidewall in a snap-fit relationship, such that the panel 202 detachably attaches to the housing 102. Thus, the operational aspects of the showcase assembly 100 remain the same, even while the bottle display means are changeable. The panel 202 is sized to enable a card or placard to slide between the sidewall and the panel 202. The displayed card may include information about the bottle or contents therein. For example, a description of a beverage, a nutrient count, and a price may display on the card.

Figure 7:
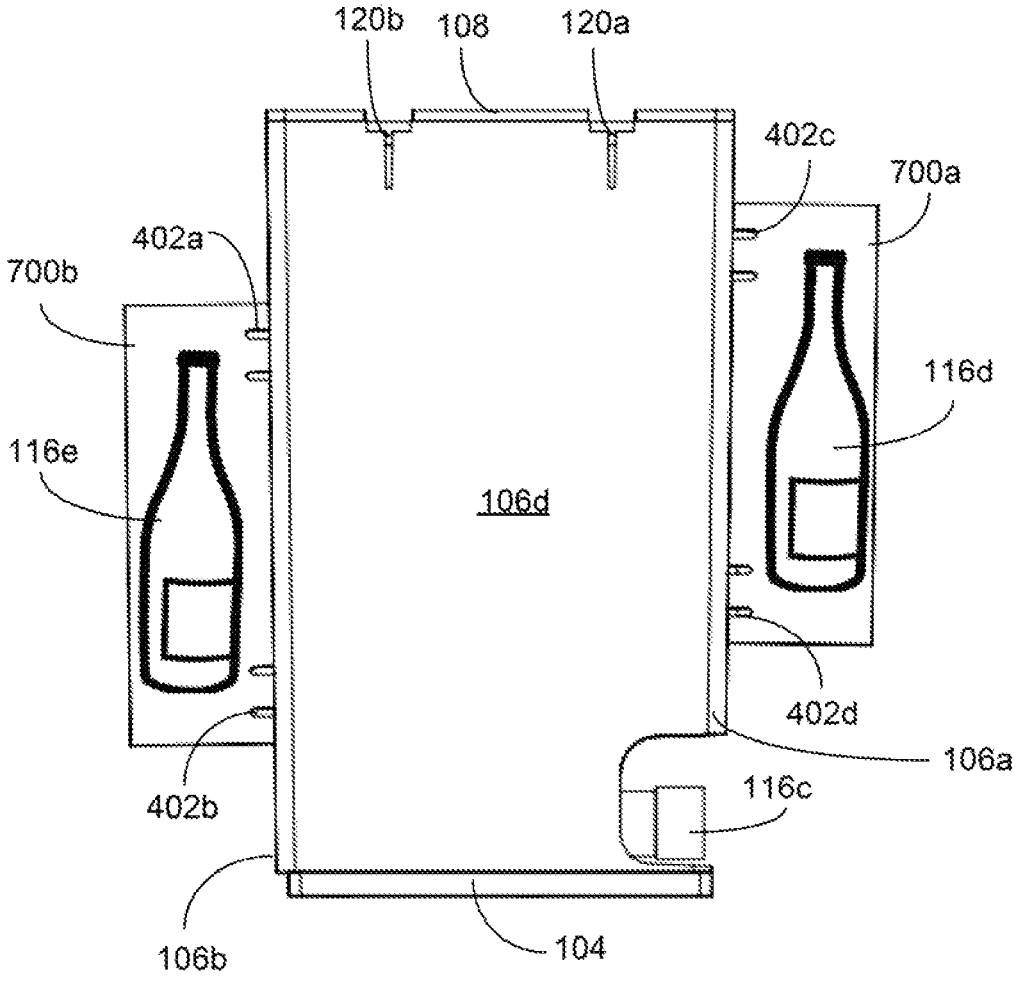
FIG. 7 illustrates a perspective view of the modular bottle dispensation showcase assembly with two transparent cases, showing a bottle removed and replaced by a subsequent bottle at the outlet opening, in accordance with an embodiment of the present invention.

In an alternative embodiment, FIG. 7 illustrates, two cases 700*a*, 700*b* attached to the housing 102. The two cases 700*a-b* can be used simultaneously to display one or two different bottles 116*d*, 200*e* from both ends of the housing 102. This can be useful for presenting the bottles 116*d*, 200*e* from both sides of a shelf or display area. Thus, as a bottle 116*a* is removed from the outlet opening 118, a subsequent bottle 116*b* replaces the removed bottle.

In conclusion, a bottle dispensation and marketing display assembly 100 for controlling access to multiple bottles 116*a-e* containing a fluid-like product that are housed for individual display and sale at grocery stores, gas stations, drug stores, and convenience stores. The assembly 100 is unique in that it provides great stability in mounting to a mounting surface, and flexibility in a display arrangement with adjacent assemblies through modular connectivity.

The assembly 100 is also unique in that an attached transparent case retains one bottle for display, and an at least partially transparent panel 202 retains an information card, business card, or other marketing card to provide bottle-pertinent information. The card creates optimal viewing and information gathering of the bottles contained within. Further, the assembly 100 utilizes gravity feed dispensing means to dispense the bottles, such that when removing a first bottle from an outlet opening, gravity causes a subsequent bottle quickly falls to the outlet opening in a controlled, aligned manner.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A bottle dispensation and marketing display assembly, the assembly comprising:

at least one housing defined by a bottom base wall and multiple sidewalls forming a cavity, the sidewalls defined by an upper end and a lower end, the upper end of the sidewalls forming multiple modular clip reception slots, the upper end of the sidewalls further forming an inlet opening, the lower end of the sidewalls forming an outlet opening, the housing being operable to enable containment of multiple bottles, whereby gravity urges the bottles from the inlet opening to the outlet opening;

multiple mounting clips disposed at the upper end of the sidewalls, the mounting clips sized and dimensioned to detachably mate with a corresponding modular clip reception slot, whereby the adjacent housings are attachable in a modular arrangement;

a lid detachably fitted to the edge of the upper end of the sidewalls;

at least one case being detachably attachable to the sidewalls, the at least one case containing at least one of the bottles for display; and at least one panel, the panel being at least partially transparent, the panel being detachably attachable to the sidewalls, the panel being operable to enable retention of a card.

2. The assembly of claim 1, wherein the outlet opening is defined by a U-shaped edge.

3. The assembly of claim 1, wherein the inlet opening and the outlet opening are disposed on opposing sidewalls.

4. The assembly of claim 1, wherein gravity urges the bottles from the inlet opening to the outlet opening when bottles are removed from the outlet opening.

5. The assembly of claim 1, wherein the bottles comprise a 50 milliliter volume.

6. The assembly of claim 1, wherein the housing has a rectangular shape.

7. The assembly of claim 1, wherein the lid forms a snap-fit relationship with the sidewalls.

8. The assembly of claim 1, further comprising at least one lid fastener operable to fasten the lid to the sidewalls.

9. The assembly of claim 1, further comprising a pair of spaced-apart, parallel mount holes forming in the sidewalls, the mount holes being sized and dimensioned to mount a mounting surface.

10. The assembly of claim 1, further comprising multiple case tabs extend from the case.

11. The assembly of claim 10, wherein the sidewalls form multiple case holes.

12. The assembly of claim 11, wherein the case tabs mate with corresponding case holes in the sidewall in a snap-fit relationship, such that the case detachably attaches to the housing.

13. The assembly of claim 1, further comprising multiple panel tabs extend from the case.

14. The assembly of claim 13, wherein the sidewalls form multiple panel holes.

15. The assembly of claim 14, wherein the panel tabs mate with corresponding panel holes in the sidewall in a snap-fit relationship, such that the panel detachably attaches to the housing.

16. A bottle dispensation and marketing display assembly, the assembly comprising:

at least one housing defined by a bottom base wall and multiple sidewalls forming a cavity, the sidewalls further forming a pair of spaced-apart, parallel mount holes, the sidewalls further forming multiple case holes, the sidewalls forming multiple panel holes, the sidewalls defined by an upper end and a lower end, the upper end of the sidewalls forming multiple modular clip reception slots, the upper end of the sidewalls further forming an inlet opening, the lower end of the sidewalls forming an outlet opening, the housing being operable to enable containment of multiple bottles, whereby gravity urges the bottles from the inlet opening to the outlet opening;

multiple mounting clips disposed at the upper end of the sidewalls, the mounting clips sized and dimensioned to detachably mate with a corresponding modular clip reception slot, whereby the adjacent housings are attachable in a modular arrangement;

a lid detachably fitted to the edge of the upper end of the sidewalls;

at least one case being detachably attachable to the sidewalls, the at least one case containing at least one of the bottles for display;

multiple case tabs extending from the case, whereby the case tabs mate with corresponding case holes in the sidewall in a snap-fit relationship, such that the case detachably attaches to the housing;

at least one panel, the panel being at least partially transparent, the panel being detachably attachable to the sidewalls, the panel being operable to enable retention of a card; and multiple panel tabs extending from the panel.

17. The assembly of claim 16, wherein the outlet opening is defined by a U-shaped edge.

18. The assembly of claim 16, wherein the inlet opening and the outlet opening are disposed on opposing sidewalls.

19. The assembly of claim 16, wherein gravity urges the bottles from the inlet opening to the outlet opening when bottles are removed from the outlet opening.

20. A bottle dispensation and marketing display assembly, the assembly comprising:

at least one housing defined by a bottom base wall and multiple sidewalls forming a cavity, the sidewalls further forming a pair of spaced-apart, parallel mount holes, the sidewalls further forming multiple case holes, the sidewalls forming multiple panel holes, the sidewalls defined by an upper end and a lower end, the upper end of the sidewalls forming multiple modular clip reception slots, the upper end of the sidewalls further forming an inlet opening, the lower end of the sidewalls forming an outlet opening, the outlet opening being defined by a U-shaped edge, the inlet opening and the outlet opening being disposed on opposing sidewalls, the housing being operable to enable containment of multiple bottles, whereby gravity urges the bottles from the inlet opening to the outlet opening;

multiple mounting clips disposed at the upper end of the sidewalls, the mounting clips sized and dimensioned to detachably mate with a corresponding modular clip reception slot, whereby the adjacent housings are attachable in a modular arrangement;

a lid detachably fitted to the edge of the upper end of the sidewalls;

at least one lid fastener operable to fasten the lid to the sidewalls;

two or more cases being detachably attachable to the sidewalls, the cases containing at least one of the bottles for display;

multiple case tabs extending from the case, whereby the case tabs mate with corresponding case holes in the sidewall in a snap-fit relationship, such that the case detachably attaches to the housing;

at least one panel, the panel being at least partially transparent, the panel being detachably attachable to the sidewalls, the panel being operable to enable retention of a card; and multiple panel tabs extending from the panel.

* * * * *